United States Patent [19]

Reiner et al.

[11] 3,953,935

[45] May 4, 1976

[54] POWER SUPPLY TOY

[75] Inventors: Lawrence L. Reiner, Woodbury, N.Y.; John P. McNett, Short Hills, N.J.

[73] Assignee: Lawrence L. Reiner, Woodbury, N.Y.

[22] Filed: Oct. 4, 1974

[21] Appl. No.: 512,086

[52] U.S. Cl. ..... 46/45; 46/265; 339/11

[51] Int. Cl.[2] ..... A63H 33/26

[58] Field of Search ..... 46/45, 243 M, 243 LV, 46/247; 339/11

[56] References Cited

UNITED STATES PATENTS

| | | | |
|---|---|---|---|
| 1,075,973 | 10/1913 | Hirsch | 339/11 |
| 2,311,276 | 2/1943 | Wilcox | 339/11 |
| 3,229,421 | 1/1966 | Ostrander | 46/247 |
| 3,466,795 | 9/1969 | Friedman | 46/243 M |
| 3,579,905 | 5/1971 | Radford | 46/244 R |
| 3,733,744 | 5/1973 | Hiltpod et al. | 46/243 LV |

*Primary Examiner*—Hugh R. Chamblee
*Assistant Examiner*—Robert F. Cutting
*Attorney, Agent, or Firm*—Lackenbach, Lilling & Siegel

[57] ABSTRACT

A toy power supply having a battery power pack and a pair of conductive leads extending therefrom; each lead having an output contact element connected thereto and the electrical output contact elements may be individual elements or form part of a glove, mitten or prong-like electric power wand or "prod". The output contact elements are compatible with pairs of input contact elements on electrically actuated toys and accessories, such as dolls. In operation, the output contact elements operate in effect as a kind of switch, and upon said contacts properly engaging a pair of input contact elements of a toy, whatever toy one is operating will then start to function, whether it is a motor or light or other accessory.

21 Claims, 17 Drawing Figures

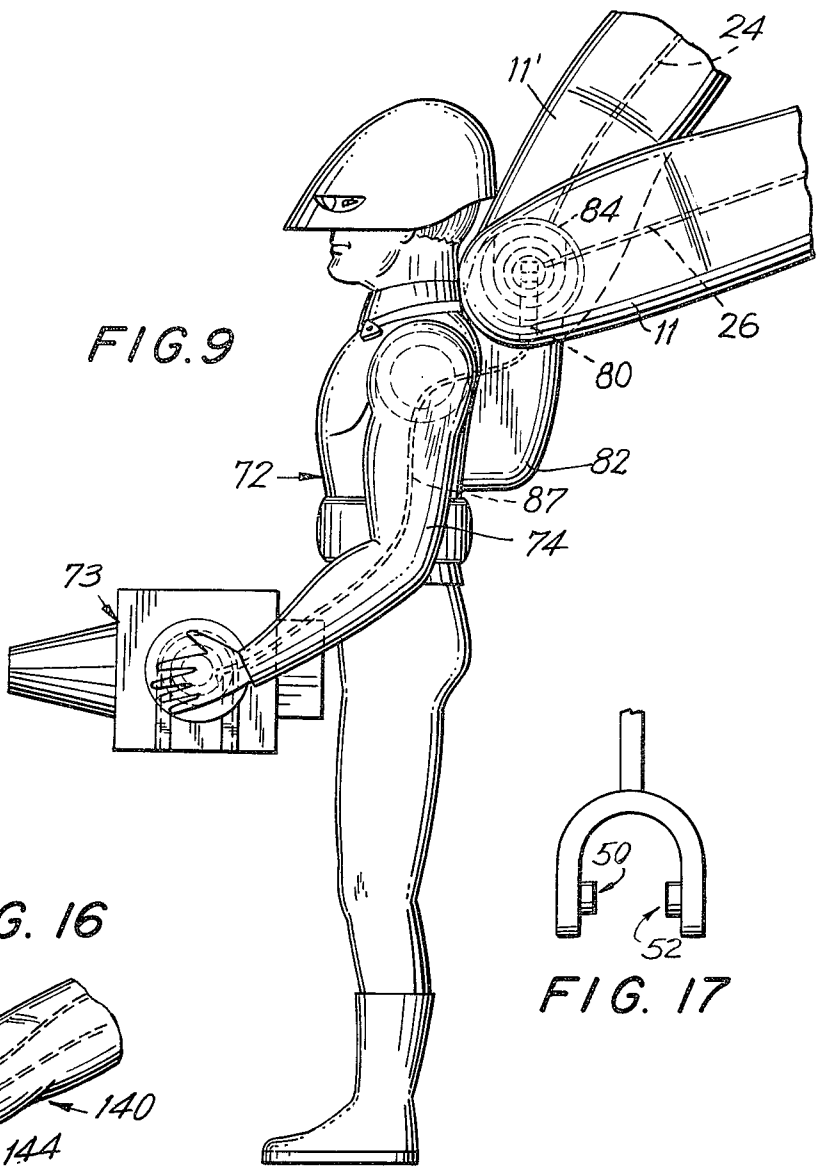
FIG. 9
FIG. 17
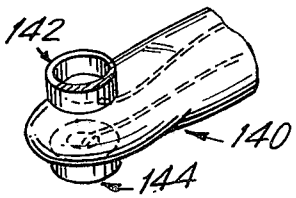
FIG. 16
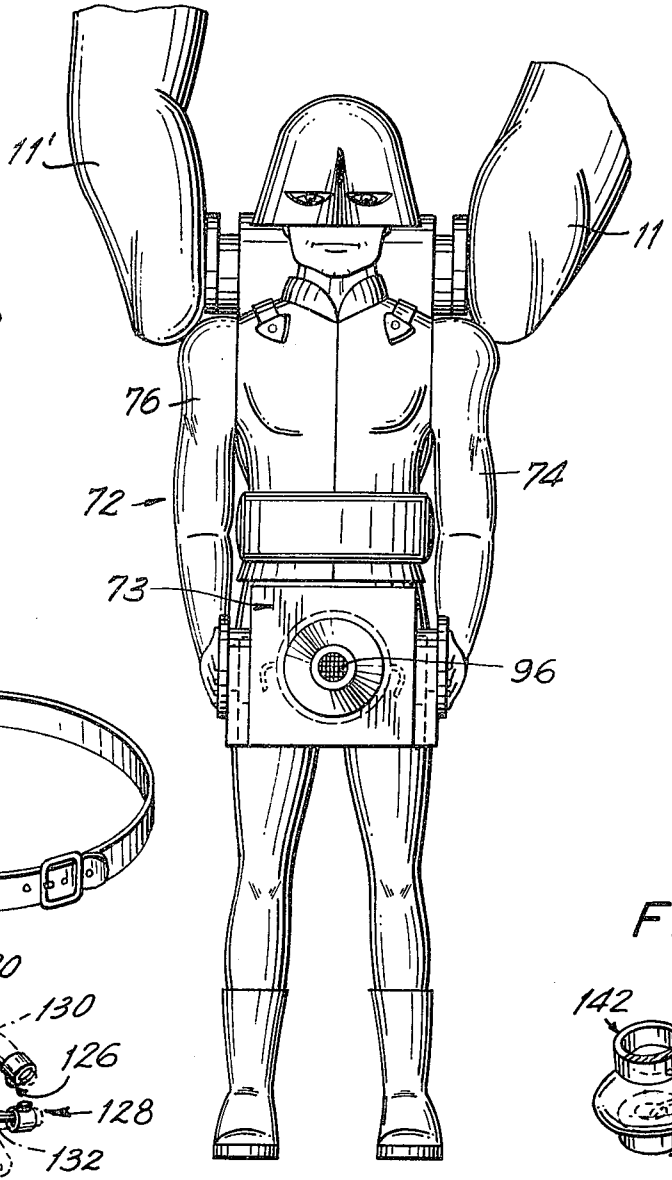
FIG. 8
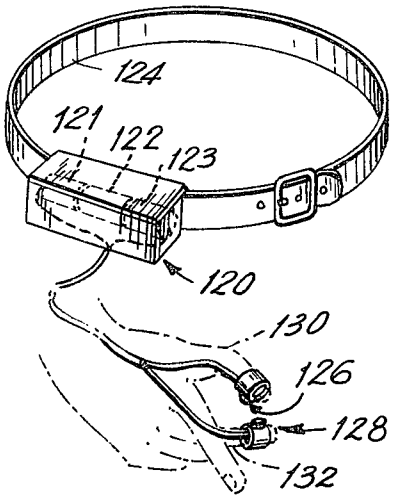
FIG. 15

POWER SUPPLY TOY

BACKGROUND OF THE INVENTION

This invention relates to electrically operated toys, and more particularly to a hand-operated powerglove-like device adapted to be used in conjunction with many different types of toys for providing electrical energization thereto.

Although there are numerous toys presently on the market which are of the motorized type, generally speaking these toys are cumbersome since they must incorporate a power source in the toy itself or the toys must be wired to an adjacent power supply source. These toys which are of the self-contained type are invariably heavier and are usually larger in size than other like toys which are not self-contained. Moreover, with a device having a separate power supply, the toy must be operated within the confines of its connecting leads. These handicaps are disadvantageous in that they tend to be distractive and restrict the operator's freedom in playing with the toys in a more challenging and educational way by manipulation requiring both mental and physical dexterity.

Furthermore, other well-known toys are provided with key-operated wind-up springs for storing energy to operate a toy. These toy devices are also objectionable in that they do not simulate scaled down versions of life-sized objects since they do not lend themselves to providing sufficient realism to the toys nor do they serve to be very entertaining and enjoyable for the children playing with such toys.

SUMMARY OF THE INVENTION

It is, therefore, a principal object of the present invention to provide a toy object of the electrically operated type which is equipped with a novel battery power pack system.

It is another object of the present invention to provide a toy device in the form of a power supply system which is adapted to energize a plurality of electrically operated toys, accessories or the like.

It is a further object of the present invention to provide a power source in the form of a glove, mitten, or wand-like shape which is connectable to the toys by means of a pair of electrical contacts.

It is still a further object of the present invention to provide a power supply toy construction and mating toy devices having the advantageous characteristics mentioned in the preceding paragraph, which are relatively simple in structure so as to be capable of economic manufacture by mass production techniques and one which is extremely durable.

These and other objects of the present invention will become apparent and will be more fully understood upon reading the following specification and referring to the accompanying drawings, which form a material part of this disclosure.

The invention, accordingly, consists in the features of construction, combination of elements, and arrangement of parts which will be exemplified in the construction hereinafter described, and, of which the scope will be indicated by the appended claims.

BRIEF DESCRIPTION OF THE DRAWINGS

FIG. 8 is a front elevational view of a toy doll holding an accessory toy device, and illustrating the positioning of the output contact elements on the toy doll for energizing the toy doll and/or the accessory device;

FIG. 9 is a side elevational view of the toy doll of FIG. 8, showing in phantom the electrical connections between each of the elements, beginning with the output contact elements at the extremities of the thumb and index finger, and ending at the input contact elements of the accessory toy device;

FIG. 15 is a perspective view of an alternate embodiment of the invention illustrating a modified power supply system, wherein the output terminal contact elements are in the form of tubes or cup-shaped sleeves, such as "thimbles" and the power pack is remotely disposed on a belt;

FIG. 16 is another alternate embodiment showing a single prong-like extension having on opposite side faces a pair of output terminal contact elements for engagement with a pair of input terminal contact elements situated in a recess of a compatible toy device; and FIG. 17 is a further alternate embodiment showing a wand, which may be hollow for accommodating a finger, having a pair of output terminal contact elements facing each other and being separated by a fixed distance.

DESCRIPTION OF THE PREFERRED EMBODIMENTS

Figure 1:
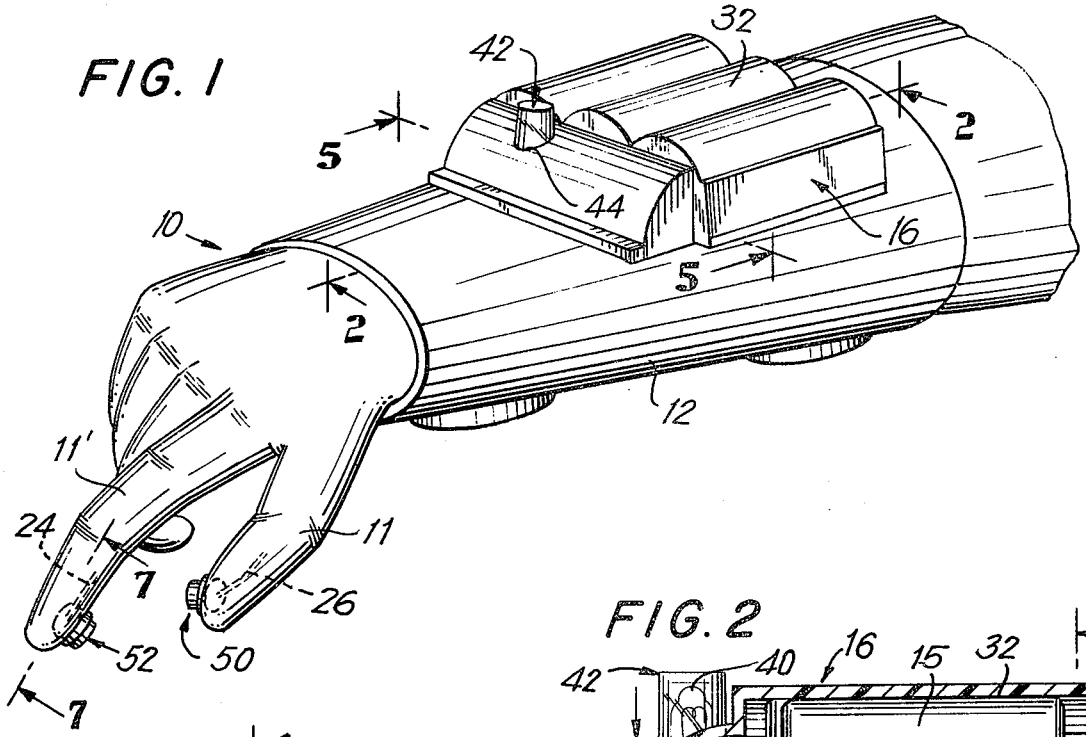
FIG. 1 is a perspective view of a power supply system of the present invention, in the form of a powerglove-like article having a built-in power pack.

Referring now to the drawings, and more particularly to FIGS. 1–5, the powerglove toy of the present invention is generally illustrated by the reference numeral 10. A gauntlet portion 12 of the glove 10 houses a plurality of batteries, such as three conventional "C" size dry cells of the Le Clanche type, by means of a base member 16 suitably secured to or forming a part of the gauntlet portion 12. The batteries comprise a row of cells 13, 14 and 15 arranged on the base 16 in a suitable fashion, such as by being vertically stacked adjacent each other, with suitable bridging contact plates 17, 18 electrically connecting the cells in series. The end cells 13 and 15, as best show in FIG. 2–5, are suitably connected by end contact strips 20, 22, respectively, which in turn are suitably connected to conductive lead lines 24, 26 extending to a pair of output terminals or contact elements 50, 52 provided on a pair of fingers of said powerglove 10.

A cover 32 is provided about the base element 16 so as to provide access to the cells. It is removable by means of a co-operating front tongue or flange portion 34 positionable in a groove 36 and a mutually co-operatively associated cam locking latch element 37 and slot opening 38 in a back flange portion of the cover 32.

If desired, a test bulb or other signalling device 40 may be employed to test the cells operability. The bulb 40 is suitably disposed beneath a transparent or translucent push-button 42 passing through an aperture 44 in the cover 32. The electrical test circuit is conventionally wired to the push-button make-break switch so that upon depression of the button 42, the light will be turned on if the cells of the power pack are not defective or dead. Although the electrical circuitry for such testing circuit does not form a part of the invention, it is further described for a better understanding of the invention. In addition, all three cells need not be tested, as any two adjacent cells obtain substantially the same end test result, namely, the three cells together are good or weak.

As seen in FIGS. 2–5, only cells 14 and 15 are tested. When button 42 is pressed down, an electrical circuit through such two cells is completed thereby illuminating a bulb 40 or ringing a buzzer indicating the power pack is in good operating condition. The testing electrical circuit is closed when contact is made upon depression of the button 42 since the socket wall portion of the bulb 40 is connected to a conductive leaf spring contact strip 31, which is in turn contacting the conductive strip 22 at the V-shaped bend 33 of the contact strip 31. In addition, the base of the bulb's socket also makes contact with the conductive strip 17 contacting the middle cell 14, thereby completing an electrical circuit between cells 14 and 15 from the bulb's terminals via strips 31, 22, 18 and 17.

The gauntlet 12 is preferably made of a strong durable material to support the power pack and yet is flexible so as to be conveniently wrapped about the wrist portion of one's arm. Thus, the gauntlet 12 may also be provided with suitable front and rear strap means 46 having hook-like elements 47 connectable to apertured means 48 on opposing strap portions for locking and holding the power supply source in place about the glove portion of said toy. As noted hereinbefore, the power pack may be mounted to the glove portion of the toy, by means well known to those skilled in the art.

Figure 6:
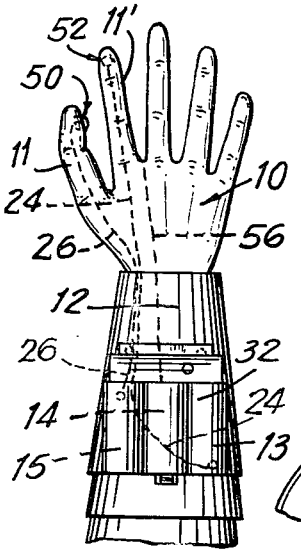
FIG. 6 is a small-scale plan view of the powerglove, showing in phantom the conductive lead lines disposed between an inner liner and the material layer forming the glove.

The glove 10 is of a construction incorporating a pair of output terminals or contact elements 50, 52 at the extremity of two fingers, preferably the thumb and another finger, and more preferably, the thumb 11 and first or index finger 11′, as best shown in FIGS. 1 and 6. The conductive leads 24, 26, which may be suitably insulated extend from the power pack to the output contact elements 50, 52. The leads 24, 26 may be provided with a suitable insulative covering, and they may extend along the outer surface of the glove 10, if desired.

Figure 2:
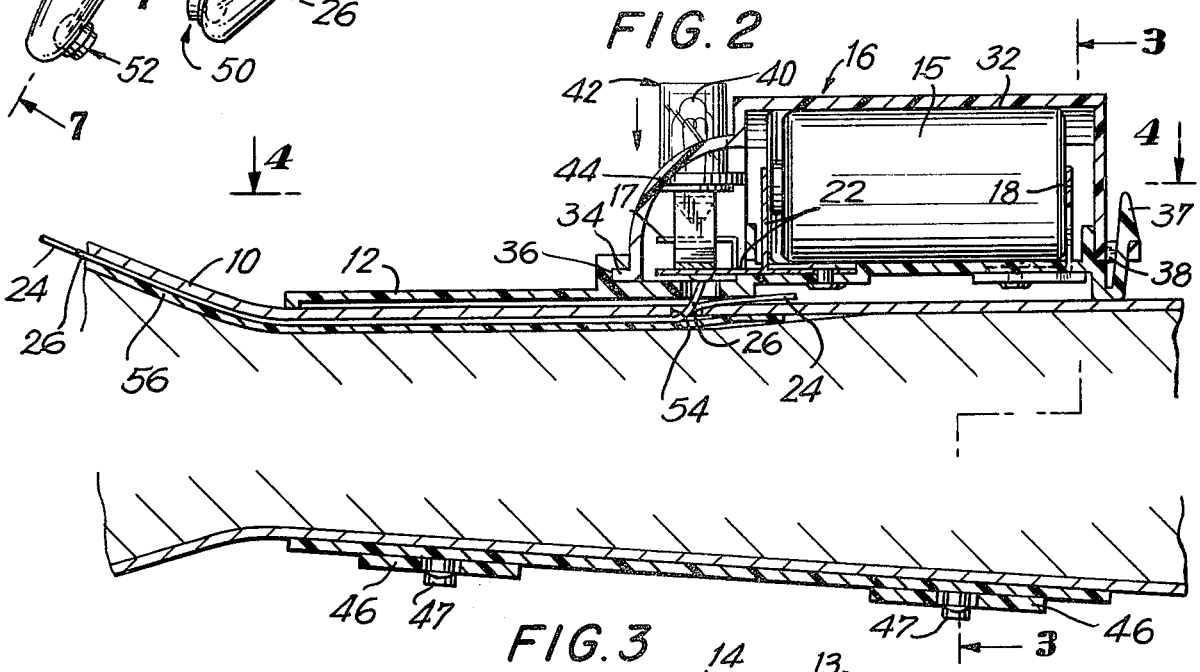
FIG. 2 is a partial longitudinal sectional view of the powerglove, taken along the line 2—2 of FIG. 1.
Figure 3:
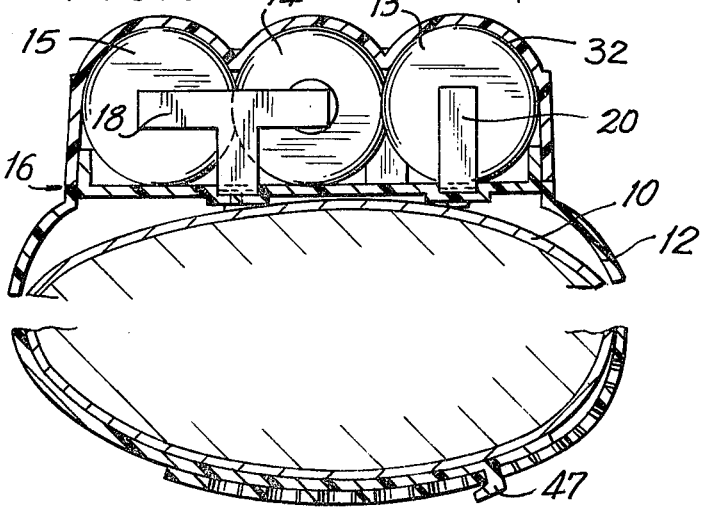
FIG. 3 is a cross-sectional view, taken along the line 3—3 of FIG. 2.
Figure 5:
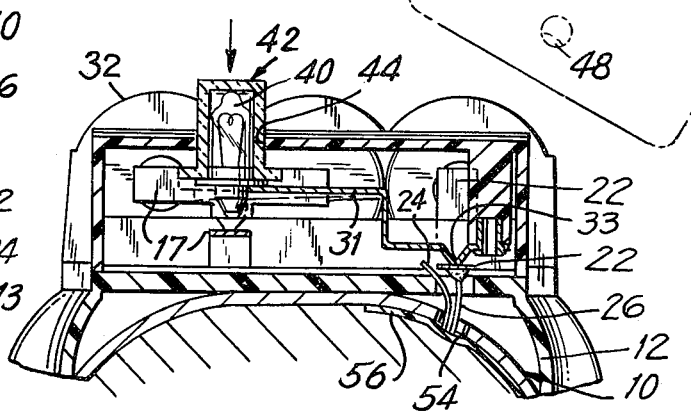
FIG. 5 is a sectional view, taken along the line 5—5 of FIG. 1.

As best shown in FIGS. 2 and 5, the leads 24, 26 extend through an opening 54 in the glove 10. These leads pass suitably between the inner wall surfaces of the glove 10 and an inner liner 56 which may extend along just those wall portions and fingers which are in juxtaposition with the extending conductive lead lines 24, 26 thereby forming a partial liner. If desired, the leads could, of course, extend outside of the glove or could even be considered as part of the glove material as embedded wires. A further alternate construction such as printed circuit leads on a plastic glove is also envisioned in the practice of the invention. The inner liner 56 and glove 10 are preferably made from non-conductive, flexible material suitably elastic as well, such as vinyl, which is also lightweight; and the liner and glove may be suitably joined together by any conventional means, as in the case of a plastic glove and vinyl liner by marginal heat seals.

Figure 7:
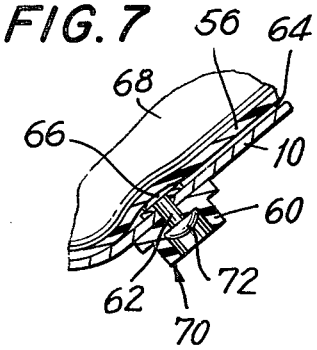
FIG. 7 is a fragmentary sectional view, on an enlarged scale of an output contact element.
Figure 4:
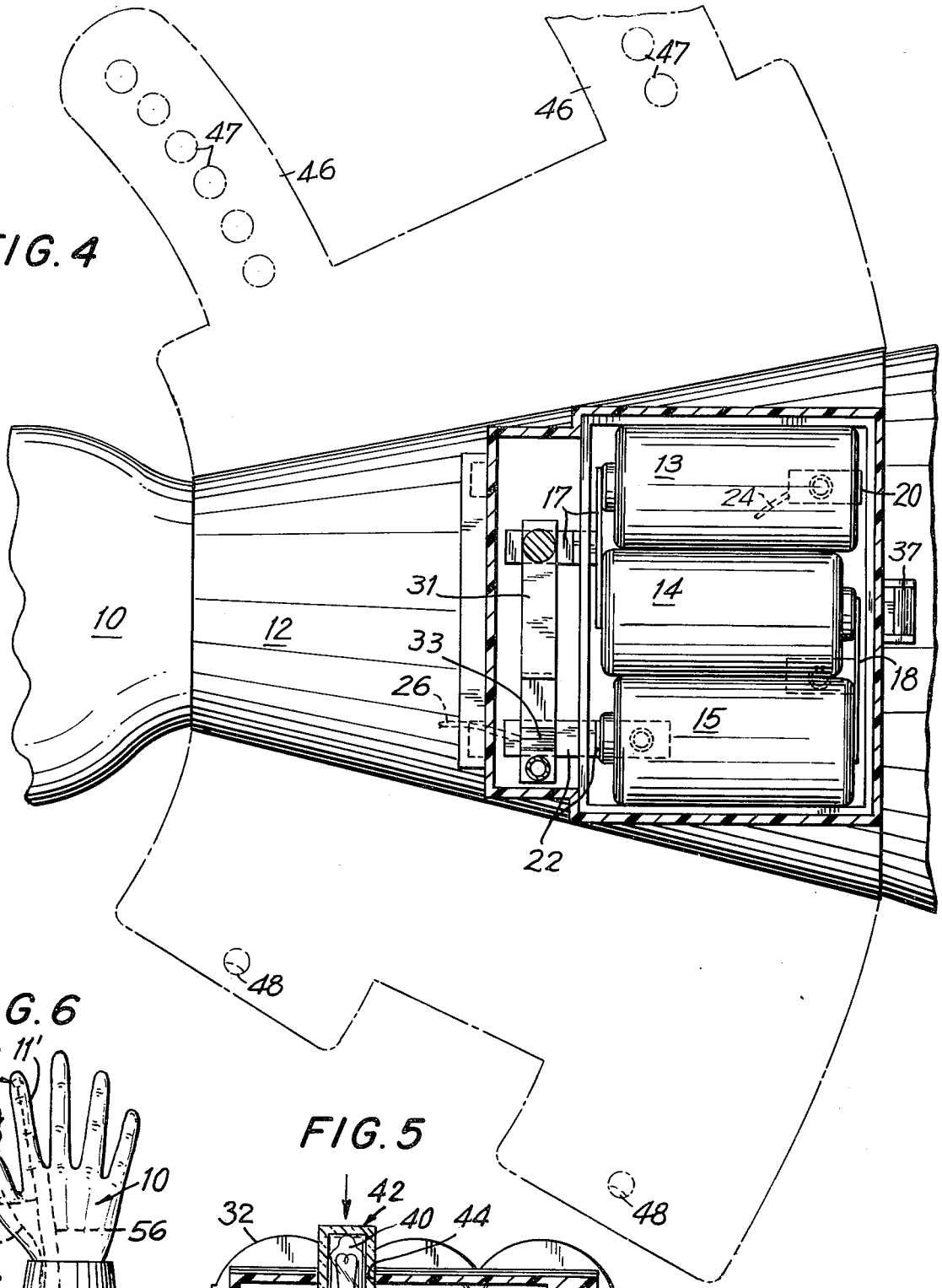
FIG. 4 is a fragmentary plan view of the powerglove of FIG. 1, with the battery pack supply system shown in section and with the wrist straps illustrated as in a development layout, but in phantom.

Contact elements 50, 52 are shown in detail in FIG. 7. As shown therein, a hollow button 60, of non-conductive material, such as styrene is held by a contact element, such as a conductive, tubular rivet 62, to the glove material 10. A conductive lead 64 having a suitable connector (not shown) at its end is also secured in electrical contact beneath the inner flattened end 66 of the rivet 62. The inner liner is shown by the reference numeral 56, and the user's finger is illustrated at 68. This electrical contact structure is the same for both output terminals or contact elements 50 and 52. Short circuiting of the contact elements 50, 52, if brought together by one's fingers, is precluded by specifying that the height of the top peripheral wall surface 70 be greater than the height of the rivet contact head 72 in the hollow button 60.

Figure 10:
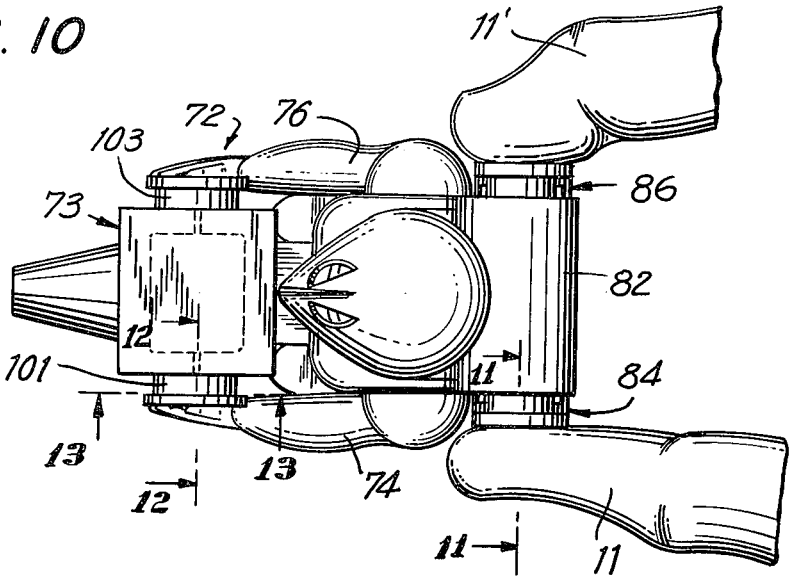
FIG. 10 is a plan view of the toy doll of FIGS. 8 and 9, showing the output contact elements in electrical contact with the input contact elements of a back-pack on the toy doll.
Figure 11:
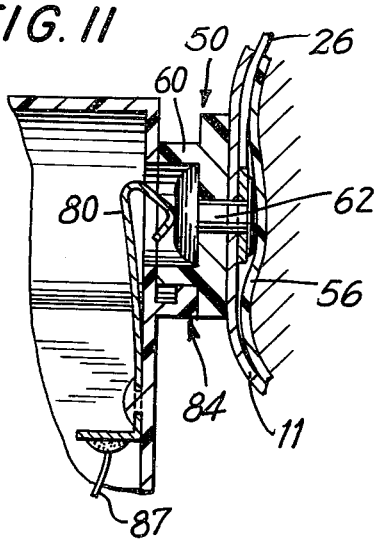
FIG. 11 is a fragmentary sectional view, taken along the line 11—11 of FIG. 10.

FIGS. 8–10 illustrate a toy "robot-like" doll 72 of the present invention having in place a removable sound- or light-generating accessory 73, a pair of generally rigid arms 74, 76 and co-operatively associated input contact elements (only one shown at 80 in FIG. 11). The contact elements are suitably for purposes of entertainment provided on a back pack 82, although they could also be provided directly on the arms 74, 76 of the toy doll 72 adjacent the shoulders thereof. A U-shaped slot 84, 86 provided about the input contact elements (80 in FIG. 11) guides and directs the output contact elements 50, 52 into firm engagement with the input contact elements. As best shown in FIG. 11, the contact element 80 is preferably in the form of a leaf spring so as to deflect into and out of the hollow button 60 as it is pushed into or pulled from electrical contact with the conductive rivet 62. Electrical contact is maintained as long as the user applies a slightly squeezing pressure maintaining positive electrical contact between the output and input contact elements. A conductive lead 87 extends from a suitable soldered contact with the contact element 80, through arm 74 to a contact element 90 provided therein in the left hand of the toy robot 72. Lead 87 is in a manner like leads 24, 26 connected to a tubular, conductive rivet 92 which in turn is brought into electrical contact with a spring-like conductive contact element 94 provided in the toy accessory 73. The removable accessory 73 shown may suitably simulate a "ray" gun by passing light from a bulb therein (not shown) through a filtering device or screen 86, or by energizing a speaker, ringing a buzzer and the like.

However, in order to insure positive electrical contact between the output terminals or contact elements of the toy robot's arms and the input contact elements of the toy accessory and to hold the toy accessory in place, flanges 98 are provided on the output contact elements which co-operate with flanges 100 on U-shaped slots 101 and 103. These flanges together lock in place the hands of the toy robot 72 to the input sockets of the accessory 73.

It will be appreciated that the toy robot 72 may be also equipped internally with a bulb behind the eye sockets and be suitably wired to the robot's contact elements so as to also light up upon electrical energization of the toy accessory 73.

Figure 13:
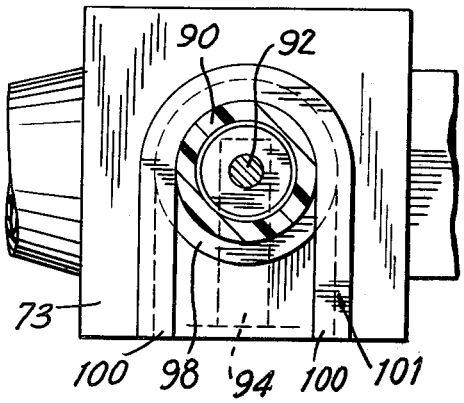
FIG. 13 is a fragmentary sectional view, taken along the line 13—13 of FIG. 10.
Figure 12:
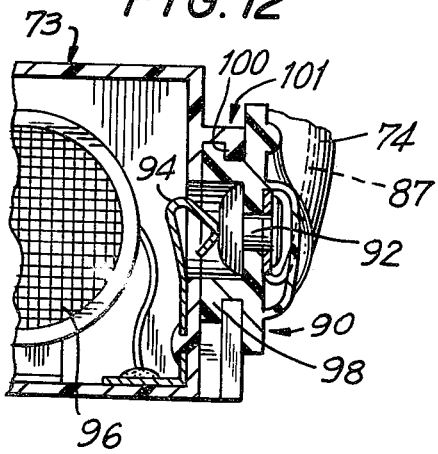
FIG. 12 is a fragmentary sectional view, taken along the line 12—12 of FIG. 10.
Figure 14:
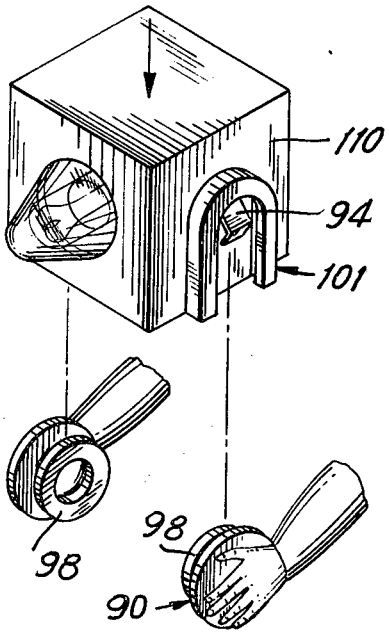
FIG. 14 is a perspective view of an alternate toy accessory, showing in greater detail the guide track means for guiding and aligning the toy doll output terminal contact elements into position electrically contacting the input terminal contact elements of the toy accessory.

In FIG. 13, the flange 100 of the U-shaped slot 101 is more clearly illustrated holding flange 98 of the contact element 90 in place after the removable toy accessory is dropped in place. Other toy accessories, such as the light box or flashlight 110 of FIG. 14, having like reference numerals for like parts, can be readily interchanged with the accessory 73 so as to provide greater entertainment value for a child playing with the toy devices of the present invention.

In FIG. 15, the power source 120, comprising three cells 121, 122, and 123 axially in line, is mounted on a belt 124 adapted to fit about the waist of a child. The hand of the child is illustrated in phantom and the contact elements 126, 128 are shown respectively disposed about the thumb 130 and the middle finger 132. The contact elements 126, 128 are suitably secured to tubular cup-shaped elements which slip over the tips of one's fingers. Thus, although the glove, mitten or other hand covering may be employed in the practice of the invention, thimble-like fingertip devices are also considered to come within the scope of the invention.

FIG. 16 shows a further embodiment of the invention wherein a probe or prod 140, which may be cup-shaped, is provided with a pair of contact elements 142, 144 on opposite sides thereof. Such device is adapted to be inserted into a mutually co-operatively associated recess in a toy doll or accessory for providing energization thereto by closing the electrical circuit of the power supply system of the invention. Of course, the output contact elements are of the same type as in the previously described powerglove embodiments, and the recess in the top devices is essentially an "inside out" version of the pair of normally outwardly facing input contact elements, with the U-shaped guides and spring contact strip elements facing each other in a recess adapted to accommodate the wand-like probe or prod, with or without a finger hole.

In FIG. 17, another wand is shown with the output contact elements facing each other and being separated by a fixed distance by the two fork elements of the yoke-like wand shown therein. This wand, as well as the wand of FIG. 16, may, if desired, be held in one's hand during play, although it should be obvious that the wand of FIG. 17 could also be provided with a recess hole for accommodating a finger of a user. The wand of FIG. 17 may also be advantageous in that the two prongs of the fork element could be suitably made to yield or deflect slightly upon contacting a pair of outwardly facing contact elements, thereby providing a firm, squeezing pressure for positive electrical contact. Of course, it will be appreciated that with a wand or prod where the contact elements are a fixed distance from each other, the hollow, non-conductive buttons may be eliminated. Such contact elements could not be shorted out because they cannot be brought together, unless, of course, an individual bridged the gap between them with a piece of metal or other conductive object.

In operation, the operator's finger and thumb operate as a kind of open switch. As soon as a user mates the thumb and finger of the powerglove of the invention with whatever is to be operated, the toy will start to operate or function, whether it is a sound or light device, or a motorized object or whatever electrical accessory is being used. The "power" of the glove, finger tip elements or prod is transferred to the toy doll or accessory device, whether the power pack supply is remotely located on a belt or forms part of the glove itself.

It will be appreciated that in manufacturing the powerglove or powermitten of the invention, it may be easier and more economically desirable to form the output contact elements in the form of cup-shaped "thimble" finger tip elements. These tip elements would then be simply secured to the tips of a thumb and finger of a glove having a gauntlet and power supply pack.

From the foregoing, it is seen that the powerglove and accessory devices of the present invention provide a commander power toy which is extremely simple in construction, so as to be capable of economic manufacture and sale, while being uniquely attractive to children of wide physical and mental range, and which otherwise fully accomplishes its intended objectives.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. A toy device for supplying electrical power to electrically actuated toys, comprising: a portable power pack having a plurality of batteries including means for being supported on some part of the body of the user, a pair of output contact elements, the spacing of which may be adjustable; and means forming conductive paths extending between said power pack and said contact elements; and said path forming an open electrical circuit condition adapted to be closed upon electrical contact with a pair of mutually co-operatively associated contact elements on a toy device to be electrically operated.

2. A toy device for supplying electrical power to electrically actuated toys, comprising: a portable power pack having a plurality of batteries adapted to be supported on some part of the body of the user, a pair of output contact elements and means forming conductive paths extending between said power pack and said contact elements; and means providing a spaced distance between said contact elements; said path forming an open electrical circuit condition adapted to be closed upon electric contact with a pair of mutually cooperatively associated contact elements on a toy device to be electrically actuated.

3. The toy device according to claim 2, wherein said means providing a spaced distance comprises a tubular finger element to accommodate the end of a user's finger, and said contact elements are provided on opposite sides thereof facing oppositely from each other.

4. The toy device according to claim 2, wherein said means providing a spaced distance comprises a yoke-like wand and each arm of said yoke-like wand is provided with a contact element; and said contact elements face each other.

5. The toy device according to claim 2, wherein said means providing a spaced distance comprises a wand-like element in the form of a prod, and said contact elements are provided on opposite sides facing outwardly therefrom.

6. The toy device according to claim 1, including a tubular finger element to accommodate the end of a user's finger for each of said output contact elements, and precluding means including an insulative element for each of said output contact elements, whereby shorting out of said contact elements if brought together is prevented.

7. The toy device according to claim 1, wherein said power pack is supported on a user's hand and forms a part of a hand covering; and one of said output contact elements is disposed on the thumb portion of said hand covering and the other of said output contact elements is disposed on the remaining portion of said hand covering.

8. The toy device according to claim 7, wherein said hand covering is in the form of a mitten, and said output contact elements are mounted on the inside tip of said thumb and the inside portion of said mitten covering the remaining fingers of one's hand.

9. The toy device according to claim 7, wherein said hand covering is in the form of a glove, and said output contact elements are mounted on the inside tips of a thumb and index finger of said glove.

10. The toy device according to claim 9 wherein said glove includes a gauntlet portion for supporting said power pack, and said conductive paths extend from said power pack on said gauntlet portion of said glove to the output contact element on said inside tip of said thumb, and to the output contact element on said inside tip of said forefinger.

11. The toy device according to claim 1 further comprising, a means for precluding said contact elements from shorting out if brought together, wherein said precluding means includes hollow, non-conductive contact elements surrounding output contact terminals of said pack recessed therein.

12. The toy device according to claim 1, including an electrically energized toy having input contact elements mutually co-operatively associated with said output contact elements of said toy device, and conductive paths extending therefrom to a second pair of output contact elements, wherein said electrically energized motorized toy includes a removable electrically actuated accessory toy, said accessory toy comprising a pair of input contact elements mutually co-operatively associated with said second pair of output contact elements.

13. The toy device according to claim 12, wherein said second pair of output contact elements on said toy are provided with means for guiding and locking same to said pair of input contact elements on said accessory toy.

14. The toy device according to claim 13, wherein said means comprise flanges on said second pair of output contact elements.

15. The toy device according to claim 14, said input contact elements on said accessory toy including groove means mutually co-operatively associated with said flange means.

16. The toy device according to claim 12, wherein said input contact elements of said toy are resilient.

17. A toy device for supplying electrical power to electrically activated toys, comprising: a portable power pack supported on a user's hand and in the form of a glove, said glove including a gauntlet for supporting said power pack, having a plurality of batteries, a pair of output contact elements, said output contact elements being mounted on the inside tips of a thumb and an index finger of said glove, and means forming conductive paths extending between said power pack and said contact elements, one of said conductive paths extending from said power pack along the inside of said glove to the inside tip of said thumb, and the other of said conductive paths extending from said power pack along the inside of said glove to the inside tip of said index finger; and said paths forming an open electrical circuit condition adapted to be closed upon electric contact with a pair of mutually co-operatively associated contact elements on a toy device to be electrically operated.

18. The toy device according to claim 17, including an inner liner separating one's hand from contact with said conductive paths.

19. The toy device according to claim 18, wherein said inner liner is a partial liner and extends only along the inner wall portions of said glove where said conductive paths are disposed in the form of wires connecting said power pack and said contact elements.

20. The toy device according to claim 19, including means securing said partial inner liner to said glove.

21. The toy device according to claim 20, said glove and said inner liner comprising elastic materials; and said inner liner is secured in place about its periphery to the inside portions of said glove.

* * * * *